US006170978B1

(12) United States Patent
Short

(10) Patent No.: US 6,170,978 B1
(45) Date of Patent: Jan. 9, 2001

(54) FLUID INDUCTOR APPARATUS HAVING DEFORMABLE MEMBER FOR CONTROLLING FLUID FLOW

(75) Inventor: David R. M. Short, London (GB)

(73) Assignee: Precision Venturi Ltd. (GB)

( * ) Notice: Under 35 U.S.C. 154(b), the term of this patent shall be extended for 0 days.

(21) Appl. No.: 09/176,547

(22) Filed: Oct. 21, 1998

(51) Int. Cl.[7] ..... B01F 5/04
(52) U.S. Cl. ..... 366/163.2; 137/893
(58) Field of Search ..... 366/163.1, 163.2, 366/167.1, 173.1, 174.1, 175.2, 176.1, 176.2, 181.5, 336, 337, 340; 137/888–895

(56) References Cited

U.S. PATENT DOCUMENTS

| | | | |
|---|---|---|---|
| 907,851 | | 12/1908 | Munson . |
| 948,648 | | 2/1910 | Hartman . |
| 1,065,494 | | 6/1913 | Andersen et al. . |
| 1,283,907 | | 11/1918 | Rigby . |
| 1,454,196 | * | 5/1923 | Trood . |
| 1,466,006 | * | 8/1923 | Trood . |
| 1,677,265 | | 7/1928 | Boving . |
| 1,839,952 | | 1/1932 | Daily . |
| 2,361,150 | * | 10/1944 | Petroe . |
| 2,780,232 | | 2/1957 | Ney . |
| 2,918,933 | | 12/1959 | Boitnott . |
| 2,968,919 | | 1/1961 | Hughes et al. . |
| 3,067,435 | | 12/1962 | Nash . |
| 3,146,195 | | 8/1964 | Berardi . |
| 3,282,227 | | 11/1966 | Nielsen . |
| 3,607,635 | | 9/1971 | Ripley et al. . |
| 3,618,263 | * | 11/1971 | Weijsenburg . |
| 4,017,565 | | 4/1977 | Muller . |
| 4,023,942 | | 5/1977 | Brady et al. . |
| 4,051,204 | | 9/1977 | Muller et al. . |
| 4,087,862 | | 5/1978 | Tsien . |
| 4,103,351 | | 7/1978 | Mamvriisky et al. . |
| 4,123,800 | | 10/1978 | Mazzei . |
| 4,150,693 | | 4/1979 | Genevey et al. . |
| 4,193,522 | | 3/1980 | Edelbach . |
| 4,415,275 | | 11/1983 | Dietrich . |
| 4,552,178 | | 11/1985 | Olsson . |

(List continued on next page.)

FOREIGN PATENT DOCUMENTS

| | | | | |
|---|---|---|---|---|
| 1030814 | | 5/1958 | (DE) . | |
| 1782158 | | 11/1971 | (DE) . | |
| 721292 | | 1/1955 | (GB) . | |
| 1101757 | | 1/1968 | (GB) . | |
| 1205776 | | 9/1970 | (GB) . | |
| 1362789 | | 8/1974 | (GB) . | |
| 1383776 | * | 2/1975 | (GB) | 366/163.2 |
| 1517509 | | 7/1978 | (GB) . | |
| 1580211 | | 11/1980 | (GB) . | |
| 2082928 | | 3/1982 | (GB) . | |
| 2263649 | | 8/1993 | (GB) . | |

OTHER PUBLICATIONS

Günther, Ing R. et al., Oxygenation with Airmaster, Intermediate Report II , Technical University Hamburg–Harburg, pp. 2–11, Jul. 23, 1999, Bloens.

*Primary Examiner*—Charles E. Cooley
(74) *Attorney, Agent, or Firm*—Weingram & Associates, P.C.

(57) ABSTRACT

An apparatus for mixing fluids includes a housing which is mounted in line with a conduit carrying a primary fluid. A deformable member is mounted in the housing and an inlet conduit carrying a secondary fluid communicates with the deformable member. An adjustment knob adjusts the width of the deformable member, thereby adjusting the venturi effect created by the deformable member in the flow of primary fluid and adjusting the flow of secondary fluid which flows into the deformable member and is induced out of the deformable member through a plurality of holes to mix with the primary fluid.

11 Claims, 5 Drawing Sheets

U.S. PATENT DOCUMENTS

| | | | | |
|---|---|---|---|---|
| 4,708,829 | | 11/1987 | Bylehn et al. . | |
| 4,917,152 | * | 4/1990 | Decker | 137/888 |
| 4,972,878 | | 11/1990 | Carlin . | |
| 5,061,406 | | 10/1991 | Cheng . | |
| 5,148,829 | | 9/1992 | Deville . | |
| 5,230,253 | | 7/1993 | Blough, Jr. et al. . | |
| 5,452,955 | * | 9/1995 | Lundstrom | 137/888 |
| 5,556,200 | * | 9/1996 | Ekholm et al. | 366/181.5 |
| 5,573,334 | | 11/1996 | Anderson . | |
| 5,720,313 | | 2/1998 | Grobbel . | |

* cited by examiner

FLUID INDUCTOR APPARATUS HAVING DEFORMABLE MEMBER FOR CONTROLLING FLUID FLOW

BACKGROUND OF THE INVENTION

1. Field of the Invention

The present invention relates generally to fluid flow apparatus and more particularly, to apparatus for introducing a secondary fluid into a primary fluid system.

2. Description of the Related Art

The prior art includes various examples of apparatus for the mixing of the fluid streams, included among which are the following U.S. Patents.

U.S. Pat. No. 907,851 to Munson discloses a flume gate in which a movable gate is mounted in a gate holder which includes cylindrical springs. The flume gate can be moved to adjust the flow through the flume.

U.S. Pat. No. 2,968,919 to Hughes et al discloses a variable area nozzle in which circumferentially spaced vanes are provided in a nozzle throat. The position of the vanes can be adjusted to restrict the flow of fluid through the nozzle in response to changes in pressure upstream from the throat.

U.S. Pat. No. 4,087,862 to Tsein discloses a bladeless mixing device in which streams are tangentially directed into an inlet mixing chamber in which a converging vortex is created which passes through an orifice into an outlet mixing chamber in which a diverging vortex is created. The stream leaves the outlet mixing chamber in a tangential direction for subsequent passage through further stages of the mixing device which include additional inlet and outlet mixing chambers.

U.S. Pat. No. 4,103,351 to Mamvriisky discloses an apparatus for controlling the density of a plugging fluid for oil and gas wells which includes an orifice which is rotatable about its longitudinal axis in the area of mixing a dry cementation material. The orifice produces a flat jet stream which rotates and mixes the dry cementation material.

U.S. Pat. No. 4,123,800 to Mazzei discloses a mixer-injector apparatus in which a throat portion having a portion of decreasing and increasing diameter is disposed between a carrier stream inlet and outlet. A port discharges additive fluid into the throat portion.

U.S. Pat. No. 4,415,275 to Dietrich discloses a swirl mixing device in which a first injector injects a first fluid into a first injection chamber and a second injector injects a second fluid into a second injector chamber. The two fluids have opposite angular momentum and meet near an opening in a collar separating the two chambers.

U.S. Pat. No. 4,552,178 to Olsson discloses a variable fluid flow restricting throttle device in which a pair of members are rotatably connected in a fluid-tight relationship and each of which includes a plurality of fluid flow openings. The members may be rotated to selectively align the fluid flow openings to create varying flow paths of varying diameters.

U.S. Pat. No. 5,061,406 to Cheng discloses an apparatus for in-line dispersion of a gas in a liquid which includes an adjustable conical mixer to control the flow of a gas\liquid mixture to a venturi device. The venturi device is used to accelerate the mixtures to a supersonic velocity with subsequent deceleration to subsonic velocity to produce shock waves in the mixture.

U.S. Pat. No. 5,230,254 to Blough. Jr. et al discloses a fluid mixing device which includes a mixing chamber and four fluid conduits which join the mixing chamber at predetermined angles to introduce fluids into the mixing chamber and create a rapid vortexing action.

U.S. Pat. No. 5,573,334 to Anderson discloses a method for the turbulent mixing of gases in which a first gas flowing from a first orifice in a tubular housing is directed at a second gas flowing from a second orifice. The two orifices are offset so as to produce a swirling action within the tubular housing.

Although the prior art includes various examples of devices intended to introduce a secondary fluid into a stream of primary fluid, there still remains a need for an apparatus which can both introduce the secondary fluid into the stream of primary fluid and control the flow of secondary fluid in a simple and effective manner.

SUMMARY AND OBJECTS OF THE INVENTION

A fluid inductor apparatus includes a hollow housing which includes inlet and outlet fluid couplings for insertion of the housing in a fluid conduit which carries a fluid which is designated as the primary fluid. An adjustment knob is rotationally mounted on an upper panel of the housing and the upper panel also includes an inlet tube for the introduction of a fluid which is designated as the secondary fluid. The inlet tube communicates with a hollow wedge member which is disposed in the hollow housing. The wedge member has a diamond shape and has four side panels which are connected by hinges thereby facilitating adjustment of the angles formed by the side panels.

The adjustment knob includes a plate with a spiral groove. A pin projecting from a motion transmission plate which has a V-shaped slot moves along the spiral groove and moves the motion transmission plate. A pair of oppositely disposed side panels on the wedge member includes guide pins which project through slots in a guide plate and the motion transmission plate. Rotation of the adjustment knob causes the wedge member to expand and contract in width.

A pair of side panels of the wedge member include a plurality of holes and secondary fluid is drawn into at least one wedge member and then drawn through the holes in the side panels and then drawn into the stream of primary fluid. Rotation of this adjustment knob changes the dimensions of the wedge member thereby varying the venturi effect caused by the wedge member and consequently controlling the flow of secondary fluid from the wedge member.

The present invention also includes a method of inducing a liquid into a flowing stream of another liquid by moving a primary liquid through a flow tube and interposing a distribution member in the flow tube for having its geometry varied to produce a low pressure area at a downstream side of the distribution member. A secondary liquid is introduced into the distribution member and drawn through passages of the distribution member toward the downstream section of the member by the low pressure created from the positioning and shaping of the distribution member with respect to the primary fluid flow.

It is an object of the present invention to provide a flow inductor apparatus which draws fluid into a main stream of fluid.

Another object of he present invention is to provide a flow inductor apparatus which utilizes a venturi effect to draw fluid into a main stream.

Another object of the present invention is to provide a flow inductor apparatus which is capable of varying the venturi effect produced by a diamond shaped wedge placed in the main stream.

Another object of the present invention is to provide a flow inductor apparatus which incorporates a flexible member to vary the venturi effect produced in a stream.

Another object of the present invention is to provide a flow inductor apparatus which incorporates a diamond shaped wedge, the profile of which may be precisely varied.

Another object of the present invention which incorporates a venturi generating component which may be adjusted by simply rotating a knob.

Another object of the present invention is to provide a fluid inductor apparatus which incorporates a hollow deformable member to create a venturi effect in primary stream.

Another object of the present invention is to provide a fluid inductor apparatus which has minimum size and bulk.

Another object of the present invention is to provide a fluid inductor apparatus which may be used to draw a secondary fluid into a primary fluid stream in an effective manner.

Another object of the present invention is to provide a fluid inductor apparatus which utilizes a motion transmission plate with a V-shaped slot to control the profile of a diamond shaped wedge.

It is another object of the present invention is to provide a fluid inductor apparatus which utilizes a plurality of holes in a hollow wedge shaped member to induce a secondary fluid into a primary fluid stream.

It is another object of the present invention is to provide a fluid inductor which utilizes a hollow wedge to create a venturi effect in a primary stream and mechanical adjustment means to vary the profile of the hollow wedge which is inserted in the primary stream.

Another object of the present invention is to provide a fluid inductor apparatus which is capable of reliable long term operation.

Another object of the present invention is to provide a fluid inductor apparatus which is both durable and relatively economical to operate.

Another object of the present invention is to provide a fluid inductor apparatus having a relatively small number of component parts which are relatively simple to manufacture resulting in a relatively low overall cost.

It is another object of the present invention to provide a fluid inductor apparatus which is easily maintained and/or repaired in a relatively short period of time, thereby reducing the overall cost of operation.

It is another object of the present invention to provide a fluid inductor apparatus which can be installed in a relatively short period of time.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE PREFERRED EMBODIMENTS

Figure 1:
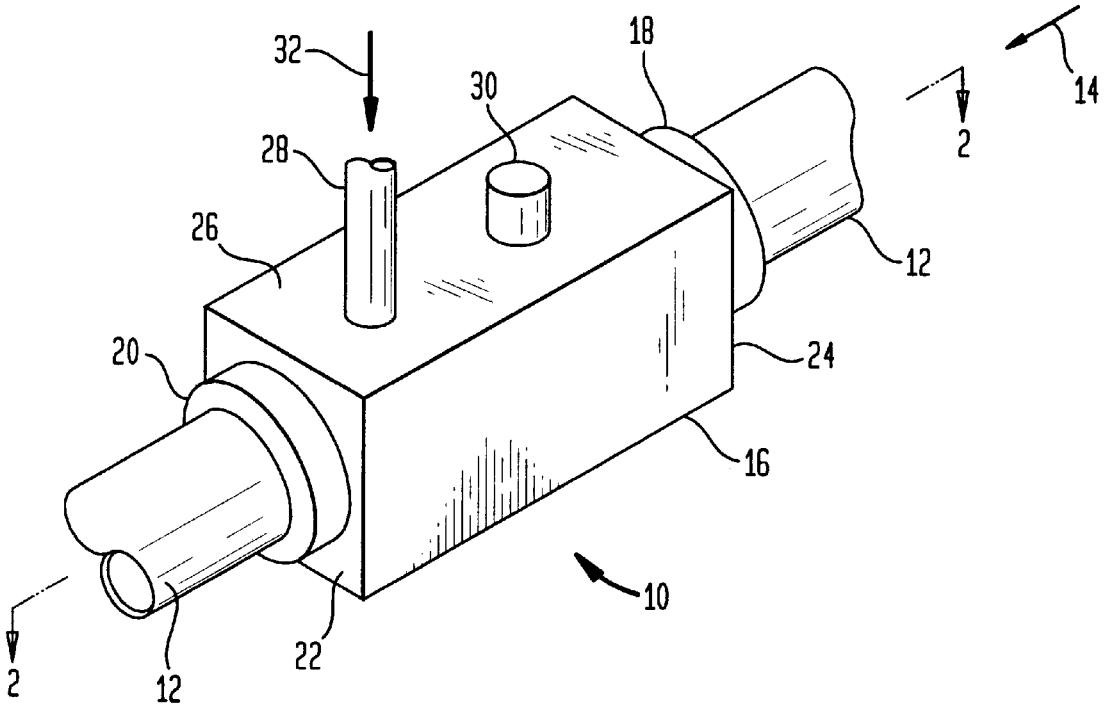
FIG. 1 is an overall perspective view of a fluid inductor apparatus according to the present invention.

In FIG. 1, a fluid inductor apparatus 10 according to the present invention is shown in a preferred embodiment inserted in a fluid conduit 12 through which there flows a fluid defined as the primary fluid. The direction of the flow of the primary fluid is shown by the arrow 14.

The apparatus 10 includes a hollow housing 16 which has fluid couplings 18,20, defined as inlet fluid coupling 18 and outlet fluid coupling 20 mounted on end panels 22,24 for interposing of the housing 16 in the fluid conduit 12. A top panel 26 of the housing 16 supports an inlet conduit 28 for a fluid defined as the secondary fluid, and an adjustment knob 30. The direction of flow of the secondary fluid is shown by arrow 32 in FIG. 1. The secondary fluid is induced to flow into the housing 16 and mix with the primary fluid in a manner which will be described below.

The top panel 26 is attached to the housing 16 in a conventional fluid tight manner.

Figure 2:
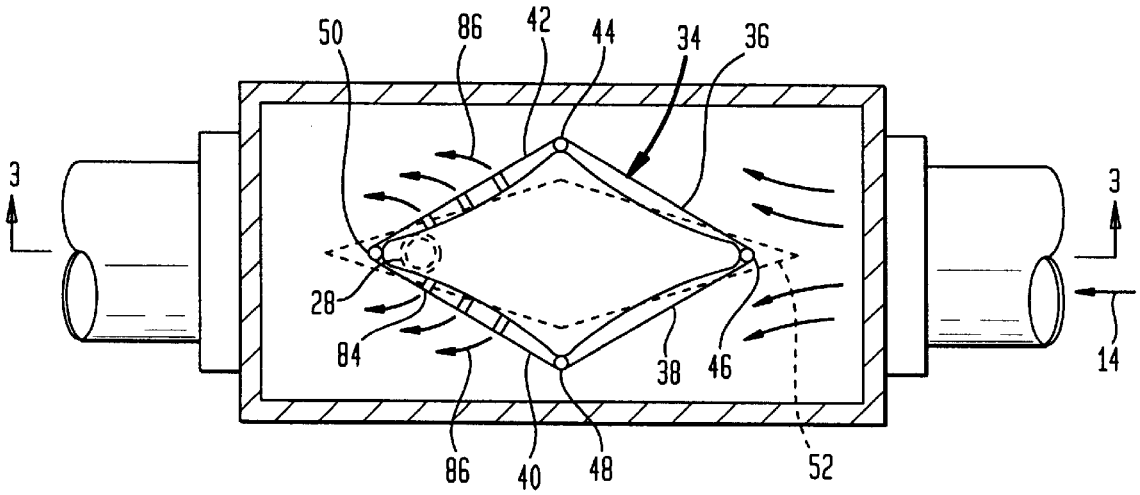
FIG. 2 is a cross-sectional view taken along the line 2—2 of FIG. 1.
Figure 3:
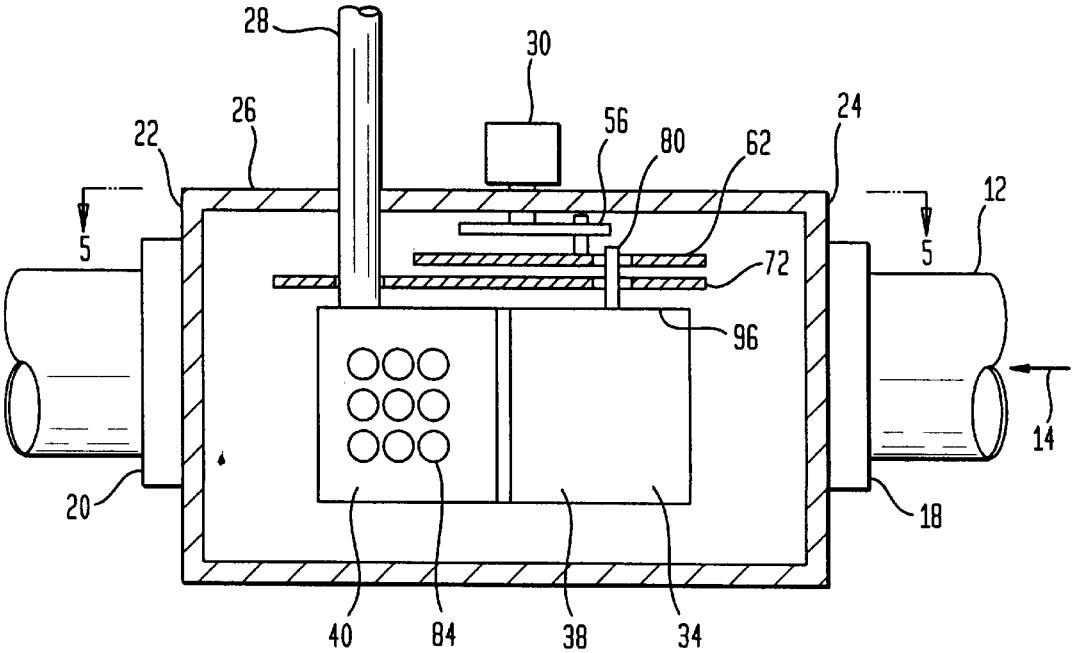
FIG. 3 is a cross-sectional view taken along the line 3—3 of FIG. 2.
Figure 4:
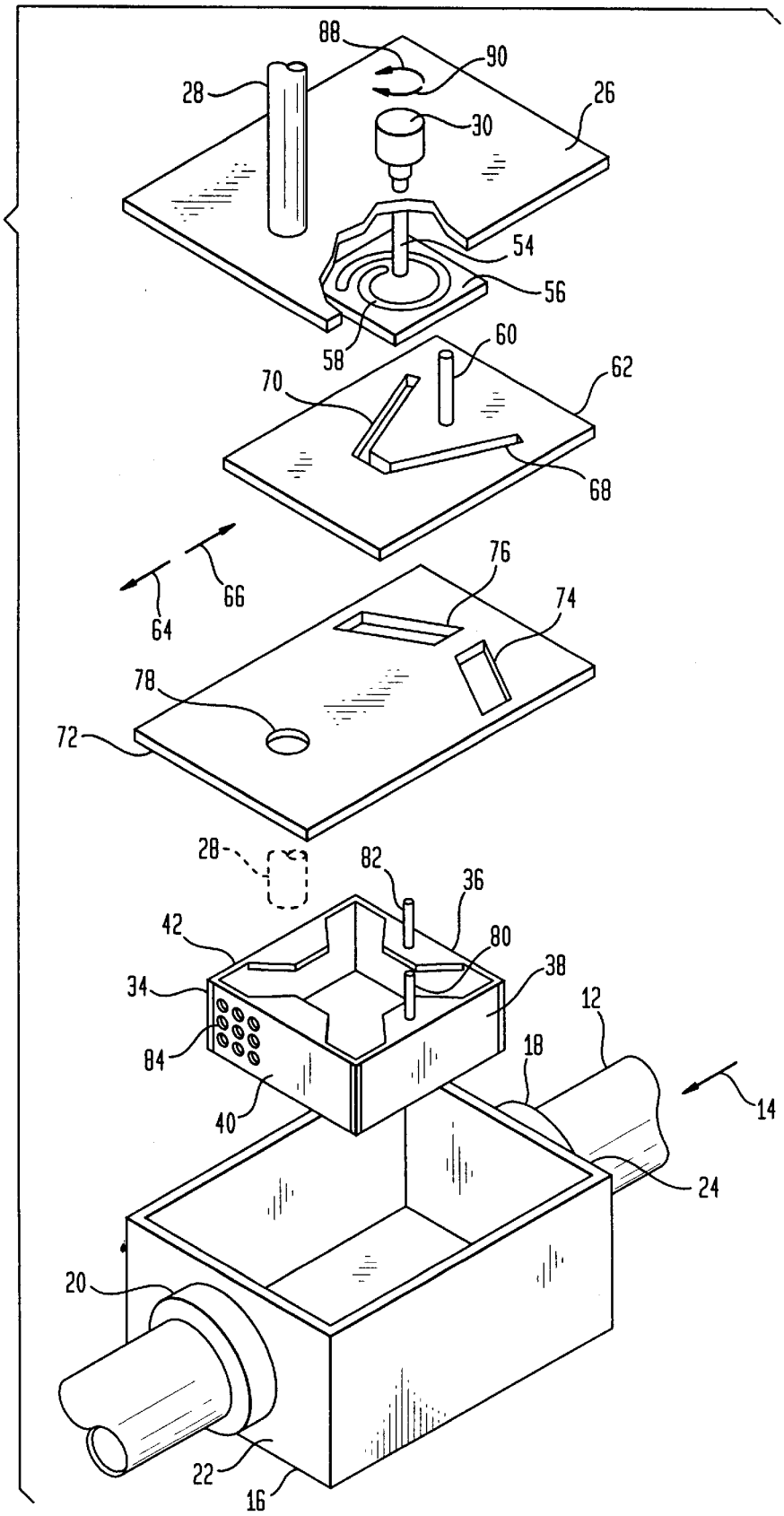
FIG. 4 is an exploded view of the apparatus of FIG. 1.

The inlet conduit 28 communicates with the secondary fluid in a hollow wedge member 34 which is disposed in the housing 16 as shown in FIGS. 2–4. The wedge member 34 has four side panels 36,38,40,42 (36–42) which are connected by hinges 44,46,48,50 (44–50) to form a diamond shaped configuration when viewed in plan view. The hinges 44–50 allow pivotal motion between adjacent panels 36–42, thereby facilitating adjustment of the dimensions of the wedge member 34 as is indicated by the broken lines 52 in FIG. 2 under the control of the adjustment knob 30.

Referring also to FIGS. 3 and 4, the adjustment knob 30 is mounted on a shaft 54 which projects through the top panel 26 into the housing 16 to a plate 56 which has a spiral groove 58. Rotation of the adjustment knob 30 causes rotation of the plate 56. A pin 60, which is mounted on a motion transmission plate 62, rides in the spiral groove 58. Rotation of the adjustment knob 30 causes motion of the motion transmission plate 62 in the direction shown by the arrow 64,66 in FIG. 4. The motion transmission plate 62 includes slots 68,70 which meet in a V-shape.

A guide plate 72 which has slots 74,76 forming-a V-shape is disposed in the housing below the motion transmission plate 62. The guide plate 72 has an aperture 78 which allows passage of the inlet conduit 28 to the wedge member 34.

Oppositely disposed side panels 36,38 include guide pins 80,82 which project upwardly through the slots 74,76 in the guide plate 72 and the slots 68,70 in the motion transmission plate 62.

Rotation of the adjustment knob 30 causes rotation of the plate 56 and the expansion and contraction of the width of the wedge member 34, thereby causing a precise adjustment in the venturi effect provided by the wedge member 34 in the flow of primary fluid.

Side panels 40, 42 of the wedge member 34 include a plurality of holes 84. Secondary fluid is drawn into the wedge member 34 via the inlet conduit 28. The secondary fluid is induced to flow through the holes 84 of the side panels 40,42 and into the stream of primary fluid as indicated by the arrows 86 in FIG. 2. Rotation of the adjustment knob 30 in the directions shown by the arrows 88,90 in FIG. 4 varies the width of the deformable wedge member 34, thereby varying the strength of the venturi effect which is created by the introduction of the wedge member 34 in the stream of primary fluid which flows through the conduit 12. The venturi effect creates an area of relatively lower pressure at the rear of the panels 40,42 and control of the venturi effect effectively controls the induction or flow of secondary fluid through the conduit 28.

Figure 5A:
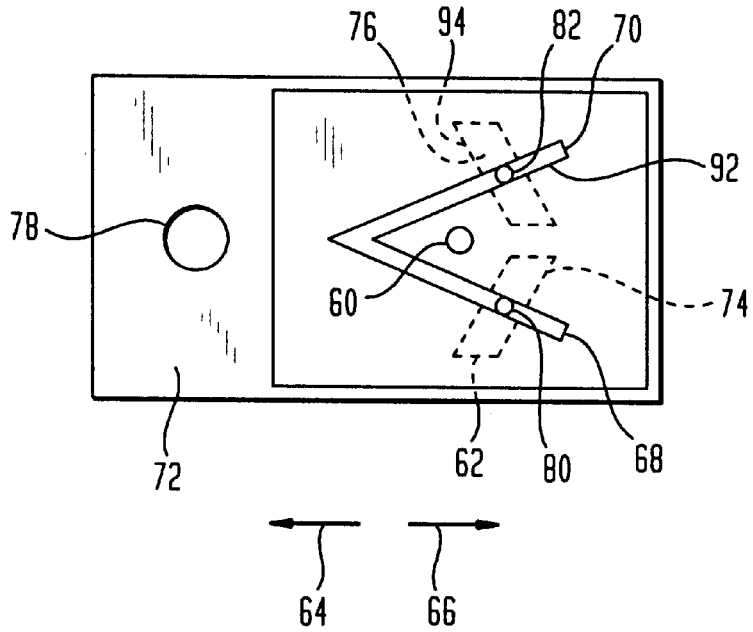
FIG. 5A is a fragmentary cross-sectional view taken along the line 5—5 of FIG. 3.

As is shown in FIGS. 4 and 5A, slots 68,70 in the motion transmission plate 62 form a relatively wider portion 92 of the V-shape, which is proximate to the inlet fluid coupling 18, while the V-shape formed by slots 74,76 has a relatively wider portion 94 which is proximate to the outlet fluid coupling 20. When the motion transmission plate 62 moves in the directions shown by the arrows 64,66 of FIG. 4, 5A, the distance between the guide pins 80,82 increases and decreases, as controlled by the adjustment knob 30, thereby changing the width of the wedge member 34. This change in width of the wedge member 34 controls the strength of the venturi effect created by the wedge member 34, and the rate of induction of the secondary fluid.

While the motion transmission plate 62 moves in the directions shown by the arrows 64,66 as described above, the guide plate 72 remains stationary covering the upper edge 96 of the wedge member 34, thereby aiding in the introduction of secondary fluid into the wedge member 34.

Figure 5B:
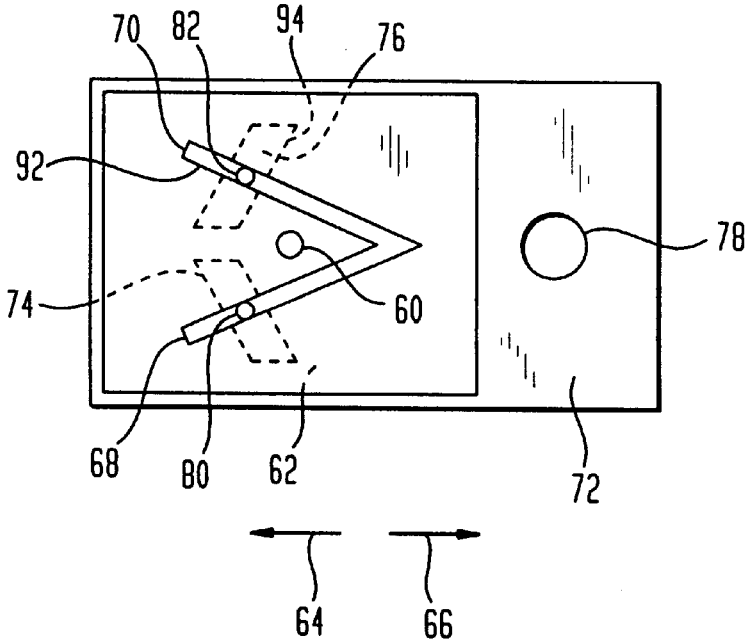
FIG. 5B is another fragmentary cross-sectional view of the fluid inductor apparatus.

Alternatively as shown in FIG. 5B, the relatively wider portion 92 of the V-shape formed by slots 68,70 may be reversed and disposed proximate to the outlet fluid coupling 20, while the wider portion 94 of the V-shape formed by slots 74,76 is disposed proximate to the inlet fluid coupling 18. Guide pins 80,82 are also now positioned on opposite side panels 40,42, and secondary inlet aperture 78 is closer to inlet 18.

Figure 6:
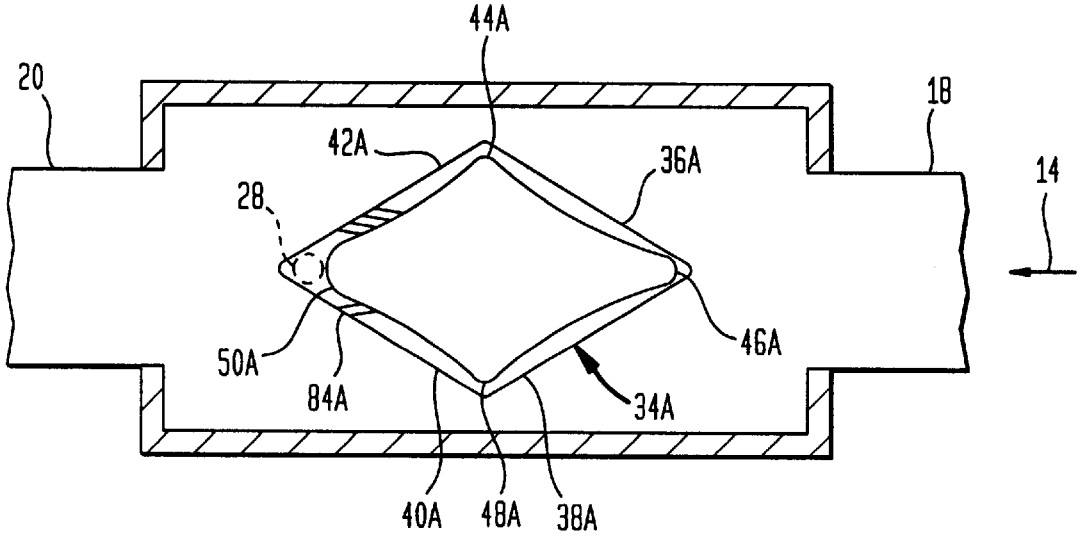
FIG. 6 is a top plan view of a portion of the apparatus shown in FIG. 4.

FIG. 6 shows another embodiment of a wedge member 34A having side panels 36A,38A,40A,42A (36A–42A) hingedly connected to form a diamond shape member. As with the wedge member embodiment 34 described above, each of the side panels 36A–42A can be constructed and arranged with respect to each other to have flexible or living hinge connections 44A,46A,48A,50A (44A–50A). With the embodiment 34A, all of the side panels 36A–42A are hollow with at least one of the side panels 40A,42A having at least one distribution passage 84A at the outlet or downstream side of the wedge member 34A. The secondary fluid is introduced into the wedge member 34A via conduit 28.

The embodiment 34A can also be constructed with only one of the side panels 40A,42A being hollow, such side panel being provided with at least one and preferably two distribution passages 84A.

The wedge members 34,34A can be of one piece construction, or constructed from the side panels 36–42 or 36A–42A which are separate and discrete panels.

The wedge members 34,34A are preferably manufactured from a plastic material.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A fluid inductor apparatus comprising:

a housing comprising:

primary fluid inlet means;

primary fluid outlet means;

secondary fluid inlet means;

hollow wedge shaped means having opposite ends disposed in said housing between said primary fluid inlet means and said primary fluid outlet means, said hollow wedge shaped means comprising a plurality of pivotable side panels, at least one of said side panels having a plurality of holes formed therein proximate to said primary fluid outlet means; and adjustment means, comprising:

a pair of guide pins projecting from opposite ones of said side panels at one end of said hollow wedge shaped means, and control means coacting with the pair of guide pins for adjusting the distance between said guide pins for deforming said hollow wedge shaped means to adjust the width thereof, said secondary fluid inlet means communicating with said hollow wedged shaped means for inducing secondary fluid to flow into said hollow wedge shaped means and through said plurality of holes into said housing.

2. The fluid inductor apparatus according to claim 1, wherein said wedge shaped means comprises four side panels.

3. The fluid inductor apparatus according to claim 2, wherein said four side panels form a diamond shaped configuration.

4. The fluid inductor apparatus according to claim 2, wherein said control means comprises:

guide plate means having a V-shaped slot arrangement said guide pins riding in said V-shaped slot arrangement.

5. The fluid inductor apparatus according to claim 1, further comprising hinge means connecting adjacent ones of said pivotable side panels.

6. The fluid inductor apparatus according to claim 1, wherein said control means comprises:

guide plate means having a first V-shaped slot arrangement; and motion transmission plate means having a second V-shaped slot arrangement with said guide pins projecting through said first and second slot arrangements in said guide plate means and said motion transmission plate means.

7. The fluid inductor apparatus according to claim 6, wherein said control means further comprises:

a pin projecting from said motion transmission plate means;

adjustment plate means having a spiral groove with said transmission plate means pin riding in said spiral groove;

drive connection means extending from said adjustment plate means through said housing; and adjustment knob means on said housing connected to said drive connection means for rotation of said adjustment plate means.

8. The fluid inductor apparatus according to claim 6, wherein said hollow wedge shaped means comprises a plurality of top edges, said guide plate means being disposed to cover said hollow wedge shaped means.

9. The fluid inductor apparatus according to claim 6, wherein said guide plate means further comprises an aperture said secondary fluid inlet means projecting into said aperture.

10. The fluid inductor apparatus according to claim 6 wherein said first V-shaped slot arrangement in said guide plate means has a relatively wider portion, said first slot arrangement relatively wider portion being disposed proximate to said primary fluid outlet means, and said second V-shaped slot arrangement in said motion transmission plate means has a relatively wider portion, said second slot arrangement relatively wider portion being disposed proximate to said primary fluid inlet means.

11. The fluid inductor apparatus according to claim 6, wherein said first V-shaped slot arrangement in said guide plate means has a relatively wider portion, said first slot arrangement relatively wider portion being disposed proximate to said primary fluid inlet means, and said second V-shaped slot arrangement in said motion transmission plate means has a relatively wider portion, said second slot arrangement relatively wider portion being disposed proximate to said primary fluid outlet means.

* * * * *